US009756897B1

(12) United States Patent
Millis

(10) Patent No.: US 9,756,897 B1
(45) Date of Patent: Sep. 12, 2017

(54) SKATING WARM UP SYSTEM

(71) Applicant: Alan Millis, Nacogdoches, TX (US)

(72) Inventor: Alan Millis, Nacogdoches, TX (US)

( * ) Notice: Subject to any disclaimer, the term of this patent is extended or adjusted under 35 U.S.C. 154(b) by 0 days.

(21) Appl. No.: 15/249,039

(22) Filed: Aug. 26, 2016

Related U.S. Application Data

(60) Provisional application No. 62/210,528, filed on Aug. 27, 2015.

(51) Int. Cl.

| | |
|---|---|
| ***A63C 1/30*** | (2006.01) |
| ***A43B 5/16*** | (2006.01) |
| ***A63C 1/00*** | (2006.01) |
| ***A43B 7/20*** | (2006.01) |

(52) U.S. Cl.
CPC ..... *A43B 5/1641* (2013.01); *A43B 7/20* (2013.01); *A63C 1/00* (2013.01)

(58) Field of Classification Search
CPC ..... A63C 1/02; A63C 1/20; A63C 1/22
USPC ..... 280/7.13, 11.12
See application file for complete search history.

(56) References Cited

U.S. PATENT DOCUMENTS 1,991,855 A * 2/1935 Johnson ..... A63C 1/20 280/11.3
2,118,892 A * 5/1938 Mays ..... A63C 1/20 280/11.3
2,874,970 A * 2/1959 Mall ..... A63C 17/18 116/DIG. 36
3,026,118 A * 3/1962 Pare ..... A63C 1/20 280/11.3
3,351,353 A * 11/1967 Weitzner ..... A63C 17/008 280/11.12
4,008,901 A * 2/1977 Conn ..... A63C 17/18 280/11.3
4,492,385 A * 1/1985 Olson ..... A63C 17/18 280/11.231
4,932,675 A * 6/1990 Olson ..... A63C 1/08 280/11.208
4,988,122 A * 1/1991 Saunders ..... A63C 17/18 280/11.12
5,314,199 A * 5/1994 Olson ..... A63C 17/0086 280/11.231
5,839,734 A * 11/1998 Steinhauser, Jr. .... A43B 5/1633 280/11.231
6,042,125 A * 3/2000 Wu ..... A63C 17/20 280/11.208
6,065,758 A * 5/2000 Steinhauser, Jr. .... A43B 5/1633 280/11.27
6,217,035 B1 * 4/2001 Steinhauser, Jr. .... A43B 5/1633 280/11.27
6,460,864 B1 * 10/2002 Shieh ..... A63C 17/18 280/11.19
6,736,411 B2 * 5/2004 Wang ..... A43B 5/06 280/11.3
7,735,840 B2 * 6/2010 Wilborn ..... A63C 17/20 280/11.27
8,544,855 B2 * 10/2013 Shepley ..... A63C 1/06 280/11.221

(Continued)

*Primary Examiner* — Jeffrey J Restifo
(74) *Attorney, Agent, or Firm* — Richard G. Eldredge; Eldredge Law Firm

(57) ABSTRACT

A skating warmup system includes a shoe having a sole and a recess running parallel with the bottom of the sole, the recess having a rail; and a spine composed of a semi-rigid material, the spine having a notch for slidingly engaging with the rail of the recess and securing the spine into the recess.

1 Claim, 4 Drawing Sheets

(56) References Cited

U.S. PATENT DOCUMENTS 9,004,501 B2 * 4/2015 Pokupec ..... A63C 1/32
280/11.12

* cited by examiner

SKATING WARM UP SYSTEM

BACKGROUND

1. Field of the Invention

The present invention relates generally to sporting equipment systems, and more specifically, to a skating system for warming up without requiring a skating rink.

2. Description of Related Art

Skating systems are well known in the art and are effective means of athletic performance and recreation. For example, FIG. 1 depicts a conventional ice skating system 101 having an ice skater 102 wearing ice skates 103 on an ice rink 104. As shown in FIG. 2, the ice skates 103 comprise a shoe portion 201 in communication with a blade 202. During use, the ice skater 102 glides across the ice 104 due to the low coefficient of friction between the blades 202 of the ice skates 103 and the ice 104.

One of the problems commonly associated with system 101 is the limitation of suitable surfaces. For example, the ice skater 102 must have access to ice 104 in order to warm up. This is understood to be a particular disadvantage for competitive skaters whose access to ice before their performance/competition is limited.

Accordingly, although great strides have been made in the area of skating systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
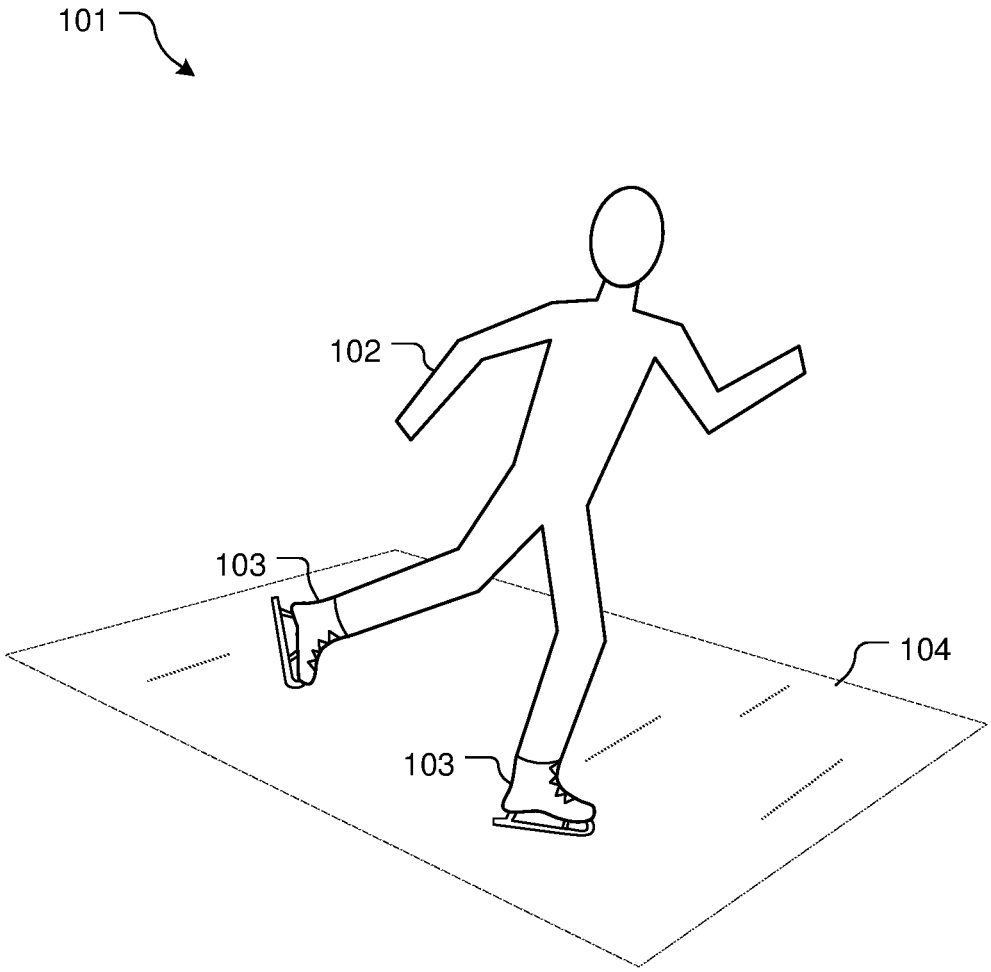
FIG. 1 (Prior Art)
FIG. 1 is an oblique view of a common skating system.
Figure 2:
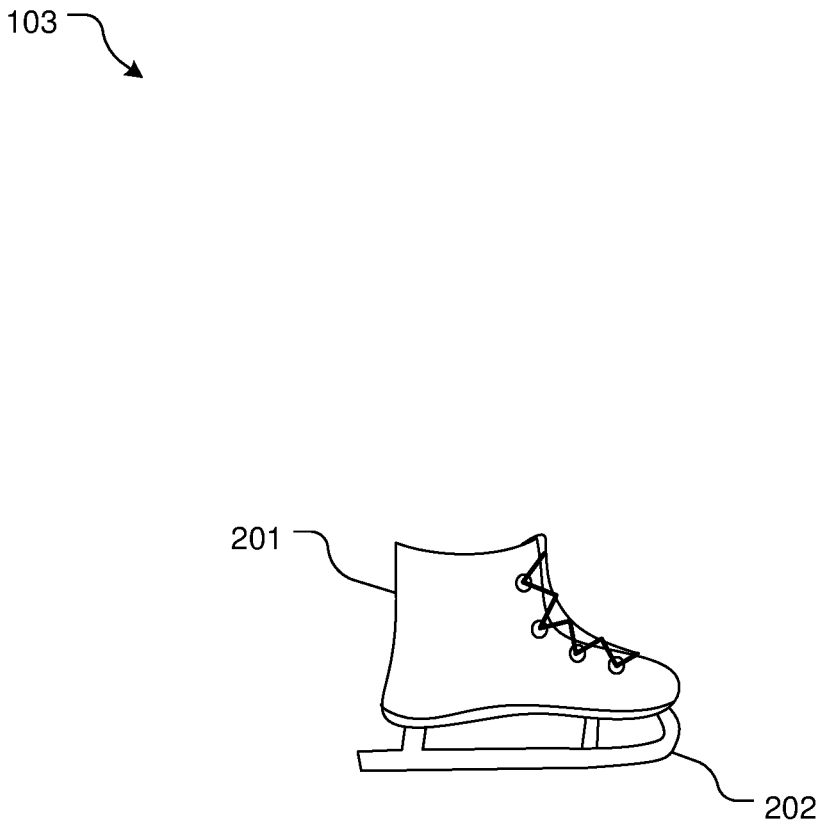
FIG. 2 (Prior Art)
FIG. 2 is a side view of the ice skate from FIG. 1.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional skating systems. Specifically, the present application provides a method for skaters to warm up without access to a skating rink. In addition, the present application provides a means to reduce unnecessary damage to conventional ice skates. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 3:
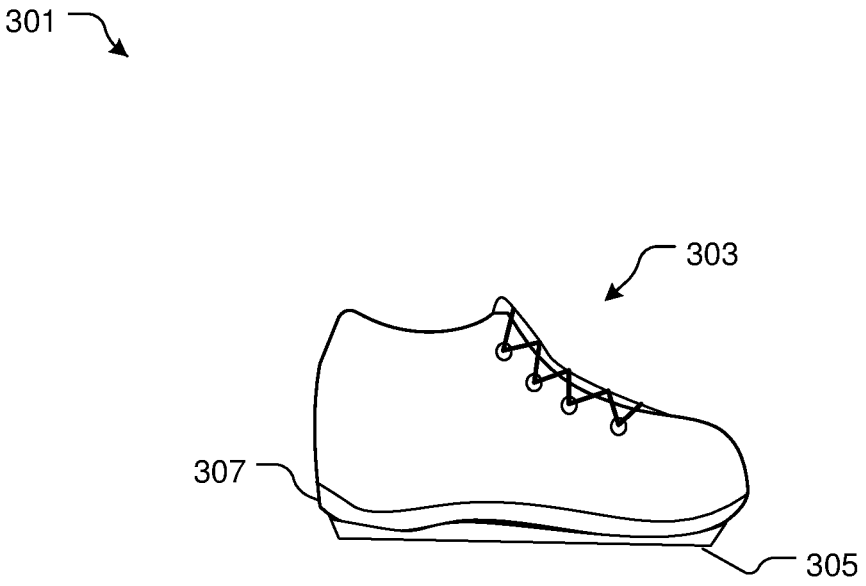
FIG. 3 is a side view of a skating warm up system in accordance with a preferred embodiment of the present application.

Referring now to the drawings wherein like reference characters identify corresponding or similar elements throughout the several views, FIG. 3 depicts a side view of a skating warm up system in accordance with a preferred embodiment of the present application. It will be appreciated that system 301 overcomes one or more of the above-listed problems commonly associated with conventional skating systems.

In the contemplated embodiment, system 301 includes a shoe 303 with a spine 305 secured to the base of the shoe sole 307, wherein the spine is composed of a semi-rigid material. During use, a user wears system 301 to warm up before putting on conventional ice skates or roller blades.

It should be appreciated that one of the unique features believed characteristic of the present application is the semi-rigid spine 305. It is understood that composing the spine 305 from a semi-rigid material, such as rubber and/or flexible plastic, allows a user to effectively warm up off the skating surface while reducing damage to the user's conventional skates. It should further be appreciated that the spine 305 provides an analogous feature to a blade or wheels on conventional skates, allowing for the user to effectively warm up joints and muscles appropriate for skating.

Figure 4A:
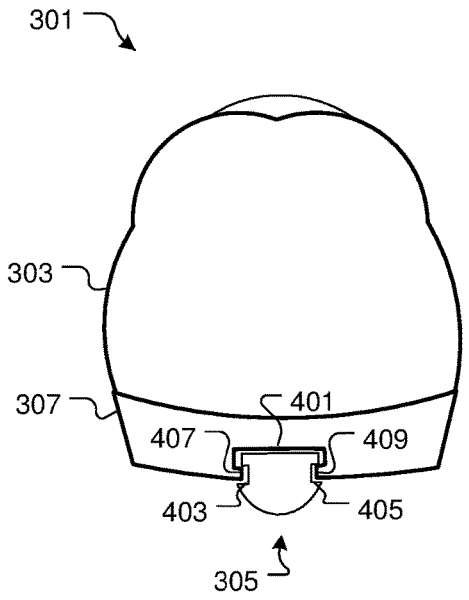
FIGS. 4A and 4B are back views of a skating warm up system in accordance with a preferred embodiment of the present application.
Figure 4B:
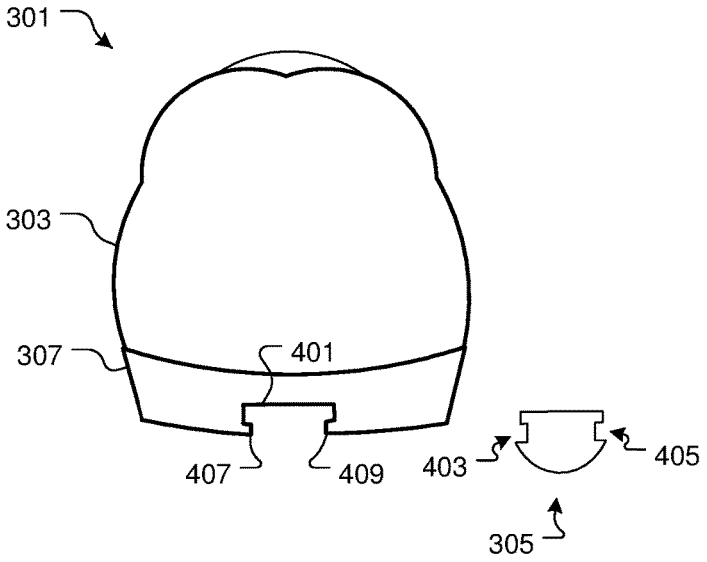

In FIGS. 4A and 4B back views of a contemplated embodiment of system 301 are shown wherein the spine 305 is secured to the sole 307 and removed from the sole 307 respectively. In the contemplated embodiment, the spine 305 is secured to the sole 307 via a recess 401, wherein the spine 305 includes one or more notches 403, 405 in sliding communication with one or more rails 407, 409 of the sole 307. It should be appreciated that any means for removably securing the spine 305 to the shoe sole 307 is contemplated, thereby allowing the user to remove and attach the spine 305 as needed for warm up.

In the preferred embodiment, the shoe 303 is composed of material ridged enough to provide moderate ankle support. However, it is contemplated that the shoe 303 can vary size, height, material, and style as functional, aesthetic, or manufacturing purposes require and have laces, clasps, hook and loop fasteners, or any other means of closure.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A skating warmup system, comprising:

a shoe, having:

a sole; and a recess integral with the sole, extending upward into the sole and running parallel with the bottom of the sole, the recess having:

a rail; and a spine composed of a semi-rigid material, the spine having:

a notch for slidingly engaging with the rail of the recess and securing the spine into the recess; and a U-shaped bottom edge configured to come into contact with the ground;

wherein the U-shaped bottom edge has a width for providing a user with enough surface area on which to balance;

wherein the spine applies pressure to a user's foot, thereby mimicking a blade;

wherein the semi-rigid material allows for flexible movement of the sole when engaged with the recess; and wherein the spine is fixed parallel to the sole of the shoe and substantially preventing the sole from coming into contact with the ground.

* * * * *